US007290532B1

(12) United States Patent
Murakami et al.

(10) Patent No.: US 7,290,532 B1
(45) Date of Patent: Nov. 6, 2007

(54) FUEL INJECTION VALVE

(75) Inventors: Tsutomo Murakami, Atsugi (JP); Gensaku Konagai, Atsugi (JP)

(73) Assignee: Nikki Co., Ltd., Atsugi-Shi (JP)

( * ) Notice: Subject to any disclaimer, the term of this patent is extended or adjusted under 35 U.S.C. 154(b) by 0 days.

(21) Appl. No.: 11/580,116

(22) Filed: Oct. 13, 2006

(30) Foreign Application Priority Data

Feb. 2, 2006 (JP) ..... 2006-025417

(51) Int. Cl.
*F02M 51/00* (2006.01)
*F02M 51/06* (2006.01)

(52) U.S. Cl. ..... 123/490; 251/129.15

(58) Field of Classification Search ..... 123/490, 123/499, 478, 467; 251/129.15, 129.16
See application file for complete search history.

(56) References Cited

U.S. PATENT DOCUMENTS 6,305,355 B1 * 10/2001 Hoffmann et al. ..... 123/467
2002/0062817 A1 * 5/2002 Endo ..... 123/467
2006/0220446 A1 * 10/2006 Jensen et al. ..... 303/3

* cited by examiner

*Primary Examiner*—Mahmoud Gimie
(74) *Attorney, Agent, or Firm*—Rader, Fishman & Grauer PLLC

(57) ABSTRACT

The present invention provides an electromagnetic driven type fuel injection valve employing an electromagnetic coil spring for a valve closing spring, which can achieve an accurate valve function over a long period of time while making interference between members caused by the valve closing spring to the minimum.

4 Claims, 2 Drawing Sheets

FUEL INJECTION VALVE

BACKGROUND OF THE INVENTION

1. Field of the Invention

The present invention relates to an electromagnetically driven type injection valve (injector) which controls a fuel supplied to an engine on the basis of an electric signal transmitted from an electronic control unit so as to inject to an intake pipe.

2. Description of Related Art

An electromagnetically driven type fuel injection valve controlled so as to be opened and closed on the basis of an electric signal output from an electronic control unit is described, for example, in Japanese Unexamined Utility Model Publication No. 55-180066, and is generally used as a normally closed type structured such that the valve is opened by exciting a stopper core 6 serving as a stationary iron by applying an electric current to an electromagnetic coil 5 to attract a plunger 10 serving as a movable iron core to move backward a needle 7 having a valve structure on a leading end side, and the valve is closed by returning the plunger 10 on the basis of an urging force of a valve closing spring 111 by stopping the current application, as shown in FIG. 3.

In the electromagnetically driven type fuel injection valve 11 using the valve closing spring 111 as mentioned above, in addition to a matter that the valve body is subtly reacted to the electric signal, it is desirable that an accurate valve function is achieved over a long period.

In this case, in the valve employing the electromagnetic coil spring for the valve closing spring 111 such as the fuel injection valve 11 shown in FIGS. 3 and 4, the valve opening and closing motion is achieved on the basis of a comparative simple structure, however, in the light of securing an accuracy of the valve function, a valve employing a disc-shaped leaf spring for the valve closing spring is excellent, such as a fuel injection valve described, for example, in Japanese Unexamined Patent Publication No. 9-79107 and Japanese Unexamined Patent Publication No. 2004-211563.

In other words, since it is possible to avoid a problem that an outer peripheral portion of a valve closing spring is brought into contact with and interfered with a peripheral member in addition that a movable core and a valve body reciprocate in a floating state without any slidable portion, by employing the disc-shaped lead spring arranged perpendicularly to the reciprocating motion of the movable core, it is possible to limit the reduction of the accuracy of the valve function caused by a motion inhibition of the movable core and an abrasion of the member to the minimum.

However, in the fuel injection valve using the disc-shaped leaf spring, in addition that a predetermined magnitude (diameter) is necessary in the leaf spring for securing a predetermined valve stroke, whereby a certain level of outer diameter (horizontal width) of the fuel injection valve is necessary, the structure becomes slightly complicated and a cost increase tends to be generated. Accordingly, in addition to the technique using the disc-shaped leaf spring, there has been desired a development of a technique which can easily achieve an accuracy of the valve function over a long period even in the valve employing the electromagnetic coil spring.

SUMMARY OF THE INVENTION

The present invention is made to solve the problems mentioned above, and an object of the present invention is to provide an electromagnetic driven type fuel injection valve employing an electromagnetic coil spring for a valve closing spring, which can achieve an accurate valve function over a long period while making an interference between members caused by the valve closing spring to the minimum.

Accordingly, in accordance with the present invention, there is provided an electromagnetically driven type fuel injection valve comprising: an electromagnetic coil case having a through hole; a stopper core serving as a stationary core fitted in the through hole of the electromagnetic coil case; a plunger serving as a movable core slidably arranged on a leading end side of the stopper core on a center axis thereof coaxial with an axis of the stopper core, the plunger having a needle insertion hole pierced from a proximal end surface thereof in a leading end direction at a predetermined depth; a needle extending from the leading end side of the stopper core and inserted at its leading end portion in the needle insertion hole, the needle having a leading end surface and an approximately columnar spring retaining portion extending from the leading end surface and having a diameter smaller than that of the needle; and an electromagnetic coil-shaped valve closing spring arranged around the spring retaining portion on its proximal end side in compression in a depth direction of the insertion hole, for urging the plunger in the leading end direction so that the valve closing spring closes the valve when an electromagnetic coil is not excited, and attracts the plunger to the stopper core to open the valve when the electromagnetic coil is excited; wherein the valve closing spring has a proximal end portion which is not elastically deformed and a center portion which is elastically deformed, the proximal end portion having a diameter smaller than that of the center portion, the proximal end portion being wound around the spring retaining portion in close contact therewith.

As mentioned above, since the proximal end portion of the valve closing spring is closely wound around and in close contact with the spring retaining portion of the needle, and the winding diameter is made smaller than that of the center portion, it is possible to limit the interference with the inner peripheral surface of the insertion hole to the minimum, and it is possible to achieve an accurate valve function over a long period, while the outer peripheral side of the proximal end portion of the valve closing spring is interfered with the inner peripheral surface of the insertion hole so as to prevent the smooth valve motion at a time when the plunger slides and the durability tends to be lowered due to the abrasion, in the conventional electromagnetically driven type fuel injection valve in which the valve closing spring is interposed within the plunger insertion hole.

Further, in the fuel injection valve, if it is arranged such that the diameter of the proximal end portion of the valve closing spring is smaller than that of the needle, so that at least the outer peripheral side of the proximal end portion of the valve closing spring does not contact the inner peripheral surface of the plunger insertion hole, the sliding motion of the plunger becomes smoother, and it is possible to make the valve function further accurate.

Further, in the fuel injection valve mentioned above, if it is arranged such that the needle is provided with a predetermined position adjusting means in the proximal end side so as to be capable of changing the insertion depth so that a valve pressure by the valve closing spring is adjustable, it is possible to easily respond to a change of the valve pressure due to various reasons.

In accordance with the present invention in which the proximal end portion of the valve closing spring arranged in the plunger insertion hole is made smaller in diameter than that of the center portion, it is possible to limit the interference between the members by the valve closing spring to the minimum, and it is possible to achieve an accurate valve function over a long period.

DESCRIPTION OF PREFERRED EMBODIMENTS

The description will be given of a best mode for carrying out the present invention with reference to the accompanying drawings. In this case, in the present invention, a portion of a valve closing spring which is not elastically deformed means a portion in which an electromagnetic coil-shaped spring is wound at an angle (in an approximately circumferential direction) at which the spring cannot be compressed in a lengthwise direction (a direction of a center line), and a portion of the valve closing spring which is elastically deformed means a portion in which the coil-shaped spring is wound at an angle at which the spring can be compressed in the lengthwise direction.

Figure 1:
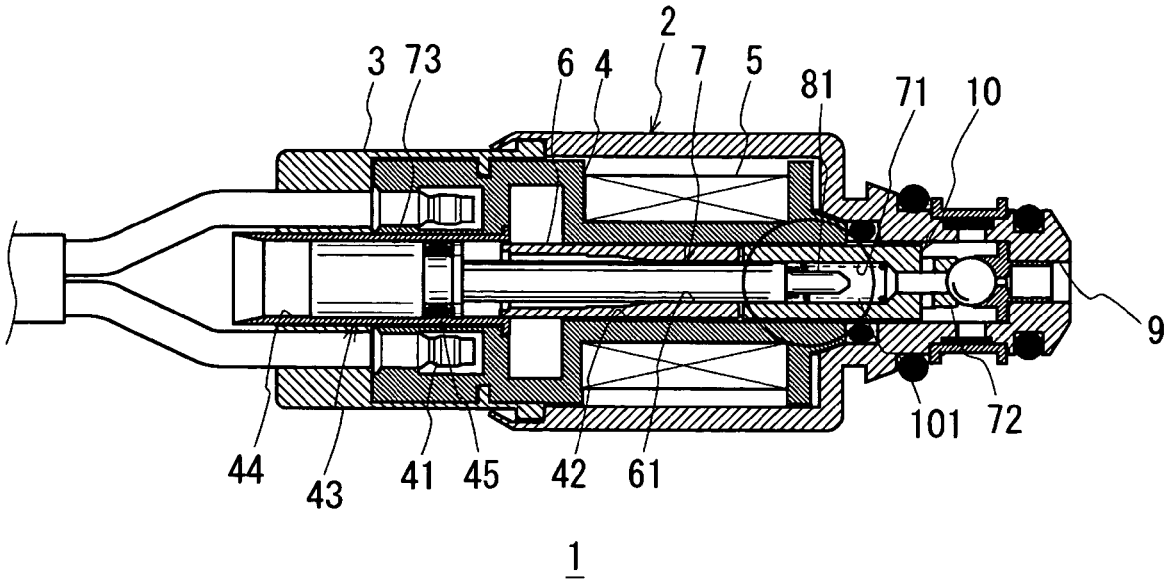
FIG. 1 is a longitudinal cross sectional view showing an embodiment in accordance with the present invention.

FIG. 1 shows a longitudinal cross sectional view of a fuel injection valve 1 in accordance with the present embodiment. The fuel injection valve 1 is formed by fitting and inserting an end cover 3 in a proximal end side of a case main body 2 provided with an injection portion in which an outer case is formed in a cylindrical shape and an injection hole 9 is provided in a leading end side. Further, an electromagnetic coil case 4 retaining an electromagnetic coil 5 and having a pair of conducting terminals 41 and 41 mounted on the proximal end side is coaxially provided within the outer case.

The electromagnetic coil case 4 is structured such that a through hole 42 is pierced in conformity to a center line, and a tubular stopper core 6 is arranged so as to be fitted and inserted in the through hole 42. The stopper core 6 is constituted by a magnetic body, and serves as a stationary core excited by applying an electric current to the electromagnetic coil 5. Further, a rod-like needle 7 is arranged so as to pass through a through hole 61 provided in such a manner as to pass through the stopper core 6 along the center line thereof, from the proximal end side to the leading end side.

The needle 7 extends from the leading end surface of an approximately columnar adjusting member 73 arranged so as to be fitted and inserted in a retaining hole 44 of a tubular retaining member 43 fixed to the electromagnetic coil case 4 in the proximal end side of the stopper core 6, has a spring retaining portion 81 formed in a columnar shape on the end surface of the leading end portion protruding from the leading end surface of the stopper core 6 and having a diameter smaller than that of the needle 7, so that an insertion depth of the needle 7 can be changed so as to adjust a valve pressure by a valve closing spring 101, by operating the adjusting member 73 in the retaining hole 44 from an opening portion so as to change a position on the center line.

An approximately columnar plunger 10 constituted by a magnetic body is arranged on a leading end side of the stopper core 6 so as to be slidable on the leading end side of the through hole 42 of the electromagnetic coil case 4 and on the center line of the stopper core 6, and a leading end portion thereof protrudes from the leading end surface of the electromagnetic coil case 4 so as to form a valve structure portion 72 in the leading end. Further, a needle insertion hole 71 is pierced at a diameter capable of inserting the needle 7 from the proximal end surface of the plunger 10 toward the leading end, and the electromagnetic coil-shaped valve closing spring 10 is provided in a spring retaining portion 81 provided in a protruding manner on the leading end surface of the needle 7 inserted in the needle insertion hole 71, is interposed in a compressed state in the depth direction of the needle insertion hole 71 between the bottom surface of the needle insertion hole 71 and the leading end surface of the needle 7, and presses the plunger 10 toward the leading end so as to energize the valve structure portion 72 in the valve closing direction.

Here, the structure mentioned above, and the valve function of closing the valve on the basis of the energizing force of the valve closing spring 101 when the electromagnetic coil 5 is not excited, and opening the valve by attracting the plunger 10 against the urging force of the valve closing spring 101 on the basis of the excitation of the stopper core 6 when the electromagnetic coil 5 is excited, are already well known techniques.

Figure 2:
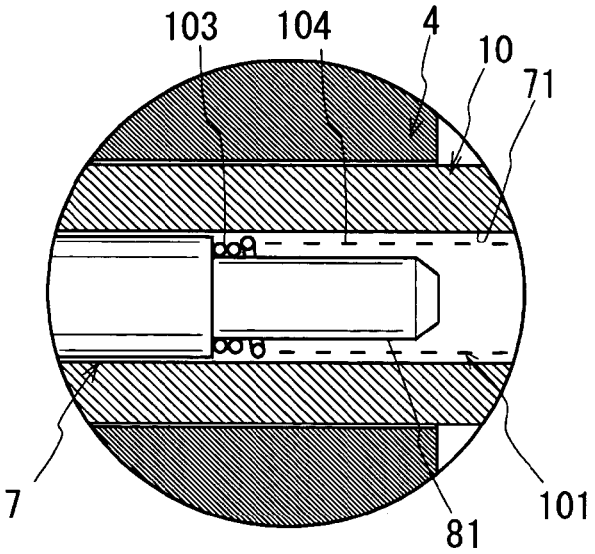
FIG. 2 is an enlarged view of a main portion in FIG. 1.

Further, the present invention has a feature in the structures of the spring retaining portion 81 arranged in the leading end side of the needle 7 inserted into the needle insertion hole 71 of the plunger 10, and the valve closing spring 101 held thereto, as shown in FIG. 2 which corresponds to the enlarged partial view of FIG. 1.

Figure 3:
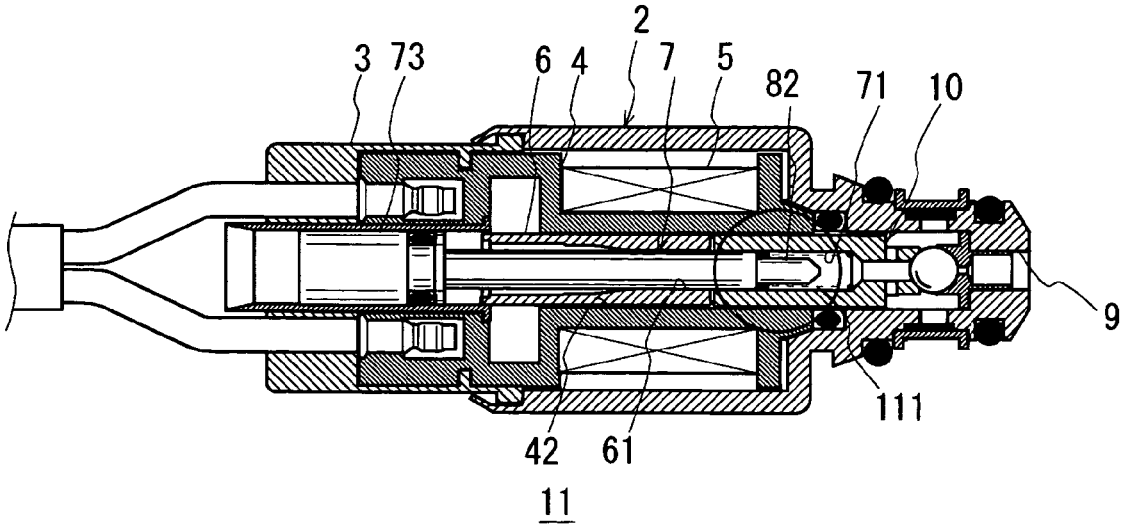
FIG. 3 is a longitudinal cross sectional view showing a prior art.
Figure 4:
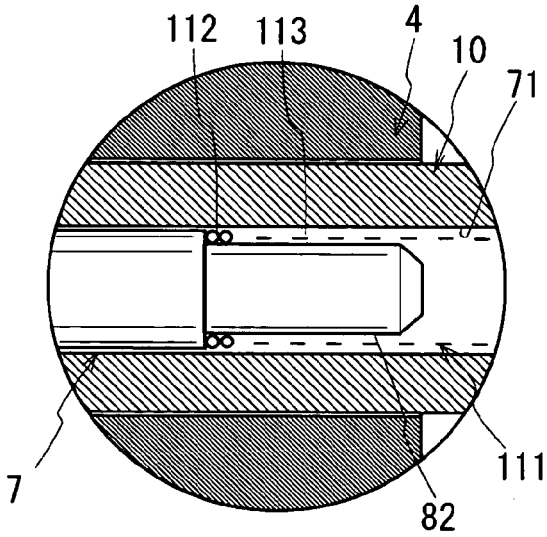
FIG. 4 is an enlarged view of a main portion in FIG. 3.

In other words, as shown in FIG. 4 which corresponds to an enlarged partial view of the fuel injection valve 11 shown in FIG. 3, the structure for urging the plunger 10 in the conventional fuel injection valve in the valve closing direction is made such that the valve closing spring 111 interposed in the compressed state in the leading end side of the needle 7 inserted into the needle insertion hole 71 so as to be fixed at its position has the same winding diameter from the proximal end portion 112 through the center portion 113 to the leading end portion, and the proximal end portion 112 corresponding to the fixed portion which is not elastically deformed has approximately the same outer diameter as the outer diameter of the needle 7. Accordingly, there is a problem that the proximal end portion 112 is interfered with the inner peripheral surface of the needle insertion hole 71 when the plunger 10 slides, and obstructs the smooth motion of the plunger 10, and it is hard to secure an accuracy of the valve function. Therefore, the problem mentioned above is solved by the present invention having the structure mentioned below.

As shown in FIG. 2 corresponding to the enlarged partial view of FIG. 1, the structure is made such that the spring retaining portion 81 in the leading end side of the needle 7 is made slightly smaller than the conventional one, and regarding spring retaining portion 81 arranged therearound, the proximal end portion 103 which is not elastically deformed is wound around the proximal end side outer peripheral surface of the spring retaining portion 81 in close contact therewith, and the elastically deformed center portion 104 has the larger diameter than the proximal end portion.

In accordance with the structure mentioned above, the outer peripheral side of the proximal end portion of the valve closing spring 111, which might be conventionally interfered with the inner peripheral surface of the needle insertion hole 71 so as to generate the trouble, is not absolutely brought into contact with the inner peripheral surface of the needle insertion hole 71 over the time from a standstill time to a sliding time, and it is possible to smoothly maintain the sliding motion of the plunger 10 so as to easily secure the accurate valve function. Further, since the friction is hard to be generated by the interference between the members, it is possible to avoid the reduction of the durability due to the abrasion.

In this case, since the valve closing spring 101 does not meander within the needle insertion hole 71 by making the outer diameter of the elastically deformed center portion 104 of the valve closing spring 101 approximately identical to the outer diameter of the needle 7, it is possible to stably achieve the urging force. Further, the adjustment in the depth direction of the needle 7 by the adjusting member 73 may be executed by turning the adjusting member 73 having a screw head formed in the proximal end side from the outer portion by a driver or the like in such a manner as to screw a thread ridge provided on an outer peripheral surface of the adjusting member 73 into the retaining hole 44 of the retaining member 43 having a thread groove, or the adjusting member 73 may be appropriately moved by setting an O-ring 45 corresponding to a seal member provided in the adjusting member 73 so as to serve as the stopper member, and applying a pressure equal to or more than a predetermined level from the outer portion.

What is claimed is:

1. An electromagnetically driven type fuel injection valve comprising:

an electromagnetic coil case having a through hole;

a stopper core serving as a stationary core fitted in the through hole of the electromagnetic coil case;

a plunger serving as a movable core slidably arranged on a leading end side of the stopper core on a center axis thereof coaxial with an axis of the stopper core, the plunger having a needle insertion hole pierced from a proximal end surface thereof in a leading end direction at a predetermined depth;

a needle extending from the leading end side of the stopper core and inserted at its leading end portion in the needle insertion hole, the needle having a leading end surface and an approximately columnar spring retaining portion extending from the leading end surface and having a diameter smaller than that of the needle; and an electromagnetic coil-shaped valve closing spring arranged around the spring retaining portion on its proximal end side in compression in a depth direction of the insertion hole, for urging the plunger in the leading end direction so that the valve closing spring closes the valve when an electromagnetic coil is not excited, and attracts the plunger to the stopper core to open the valve when the electromagnetic coil is excited;

wherein the valve closing spring has a proximal end portion which is not elastically deformed and a center portion which is elastically deformed, the proximal end portion having a diameter smaller than that of the center portion, the proximal end portion being wound around the spring retaining portion in close contact therewith.

2. The fuel injection valve as claimed in claim 1, wherein the diameter of the proximal end portion of the valve closing spring is smaller than that of the needle, so that at least the outer peripheral side of the proximal end portion of the valve closing spring does not contact the inner peripheral surface of the plunger insertion hole.

3. The fuel injection valve as claimed in claim 1, wherein the needle has a predetermined position adjusting means in the proximal end side so as to be capable of changing the insertion depth so that a valve pressure by the valve closing spring is adjustable.

4. The fuel injection valve as claimed in claim 2, wherein the needle has a predetermined position adjusting means in the proximal end side so as to be capable of changing the insertion depth so that a valve pressure by the valve closing spring is adjustable.

* * * * *